United States Patent [19]

Hartmann et al.

[11] 4,093,763

[45] June 6, 1978

[54] MULTIPLE-LAYERED NON-WOVEN FABRIC

[75] Inventors: Ludwig Hartmann, Kaiserslautern; Paul F. Maahs, Bad Durkheim; Lüder Gerking, Kaiserslautern; Ivo Ruzek, Kaiserslautern; Eberhard Schäfer, Kaiserslautern, all of Germany

[73] Assignee: Lutravil Spinnvlies GmbH & Co., Kaiserslautern, Germany

[21] Appl. No.: 621,069

[22] Filed: Oct. 9, 1975

[30] Foreign Application Priority Data

Oct. 10, 1974 Germany ..... 2448299

[51] Int. Cl.[2] ..... B32B 27/34; B32B 27/36

[52] U.S. Cl. ..... 428/95; 427/377; 427/378; 428/97; 428/212; 428/218; 428/287; 428/288; 428/296; 428/447

[58] Field of Search ..... 428/95, 96, 97, 198, 428/212, 218, 284, 287, 288, 296, 447; 427/377, 378

[56] References Cited

U.S. PATENT DOCUMENTS

| | | | |
|---|---|---|---|
| 3,563,838 | 2/1971 | Edwards | 428/95 |
| 3,936,558 | 2/1976 | Bolen | 428/218 |

*Primary Examiner*—Marion E. McCamish
*Attorney, Agent, or Firm*—Keil, Thompson & Shurtleff

[57] ABSTRACT

Disclosed is a multiple-layered non-woven fabric particularly suited for use as backings for tufted carpets in view of its excellent strength and dimensional stability properties. The non-woven fabric is characterized by specifically defined strength parameters and by a graduaton of bonds throughout the thickness thereof, so that both surfaces differ from each other insofar as the degree of filament bonding is concerned.

13 Claims, 4 Drawing Figures

MULTIPLE-LAYERED NON-WOVEN FABRIC

BACKGROUND OF THE INVENTION

The present invention relates to non-woven fabrics, and more especially to multiple-layered non-woven fabrics which are bonded with synthetic binder filaments and which are useful as backing material for tufted carpets.

It is known to use non-woven fleeces or webs as tuft backing for carpets. For example, in German Auslegeschrift No. 1,635,583 there is described a non-woven fleece as such a tuft backing. A backing material for tufted carpet is built up from a non-woven fleece, the fibers of which are bound with a spectrum of adhesive strengths, whereby however, this spectrum of adhesive strengths is throughout the thickness of the material. The spectrum of the different adhesive strengths is supposed to give rise to the result that the fiber bonds having the lowest adhesive strength loosen themselves during tufting and surround the pile yarn, and the fiber bonds of higher strength produce the mechanical cohesion. However, as a result of the fact that this spectrum of adhesive strengths is symmetrically present throughout the thickness of the material on both sides of the carpet, there arises the disadvantage that the upper side of the backing material facing the pile layer contains a high percentage of fibers of lower fusion, so that when the carpet is later used, these fibers are eliminated from the binding and end up on the visible side of the carpet.

Also, from German Offenlegungsschrift No. 1,760,811 there is known a tuft backing which is formed from a plurality of layers, whereby an anisotropic fiber disposition of the layers in the entire binding of the fleece is chosen, in order to satisfy the different strength requirements during the tufting procedure. It has been shown, however, that this stratified anisotropic construction is detrimental in that the part of the fleece facing the side to be coated is penetrated by the coating material during the anchoring of the tuft-pile yarn, so that the different layers of aniostropically supported fibers are enveloped non-uniformly by binder. This leads to the result that the laying behavior of such carpets is impaired by the strongly defined anisotropy of the carpet.

SUMMARY OF THE INVENTION

It is therefore an object of the invention to provide an improved non-woven fleece for the manufacture of carpeting which overcomes the above-delineated disadvantages.

In accomplishing the foregoing objects, there has been provided in accordance with the present invention multiple-layered, binder-filament-bonded non-woven webs of continuous polyester filaments, which webs exhibit in essence isotropic strength parameters over the surface, so that no preferred direction is present. The weight per unit area of the webs lies between about 100 and 150 metric pounds (p)/m$^2$, and the webs have in the untufted condition a specific strength parameter A, where $A$ is defined as $$A = \frac{\text{Breaking load of a 5 cm wide strip in } p}{\text{Weight per unit area in } p/m^2}$$

After the webs are tufted with a continuous crimped polyamide yarn having a total denier of 2,700 dtex, with the needle separation being 0.397 cm and the stitch tightness being 0.32 cm, they have the strength parameters B and C, where $B$ is defined as $$B = \frac{\text{Breaking load of a 5 cm wide strip in } p, \text{ measured along the tuft rows}}{\text{Weight per unit area of the non-woven web } p/m^2}$$

and $C$ is defined as $$C = \frac{\text{Breaking load of a 5 cm wide strip in } p, \text{ measured transverse to the tuft rows}}{\text{Weight per unit area of the non-woven in } p/m^2}$$

The bonds between the polyester filaments forming the non-woven web, both as regards their number and their magnitude and structure, are clearly graduated over the entire thickness of the web, so that both sides of the non-woven web differ substantially from one another in the filament binding or fusion. The invention is characterized especially in that (a) the strength parameter A has a value of at least 130, (b) the strength parameter B has a value equal to or greater than 0.9 A, but is at least 140, and (c) the strength parameter C has a value equal to or greater than 0.8 A, but at least 120.

Under the term multiple-layered, binder-filament-bonded non-woven fabrics, there are also to be understood such non-woven fabrics with which there is present a differential bonding throughout the entire material thickness which is graduated in layers, so that both sides of the non-woven web (top and bottom sides) differ substantially from one another by virtue of the filament bonding.

The bonds between the polyester filaments making-up the non-woven web or fleece are clearly graduated with respect to their magnitude and structure through the thickness of the web. An advantageous graduation of the strength properties of the multiple-layered non-woven web is provided by the arrangement wherein the material which is divided into two layers of equal thickness exhibits the following characteristics of the two layers:

(a) The tensile strength of the densely consolidated layer amounts to at least 2 times that of the loosely consolidated layer; and (b) The density of the densely consolidated layer amounts to at least 1.2 times that of the loosely consolidated layer.

Particularly advantageous properties are exhibited by such non-woven backing fabrics, in connection with which the bending resistance, measured in the direction proceeding from the soft side, is at least 1.5 times, more preferably greater than 2 times, as much as that which is measured in the direction proceeding from the hard side, whereby the bending resistance of the densely consolidated layer of a web divided only into two layers of equal thickness amounts to at least 2 times that of the loosely consolidated layer.

Other objects, features and advantages of the invention will become apparent from the following detailed description of preferred embodiments of the invention, when considered together with the accompanying drawings.

DETAILED DESCRIPTION OF PREFERRED EMBODIMENTS

Figure 1:
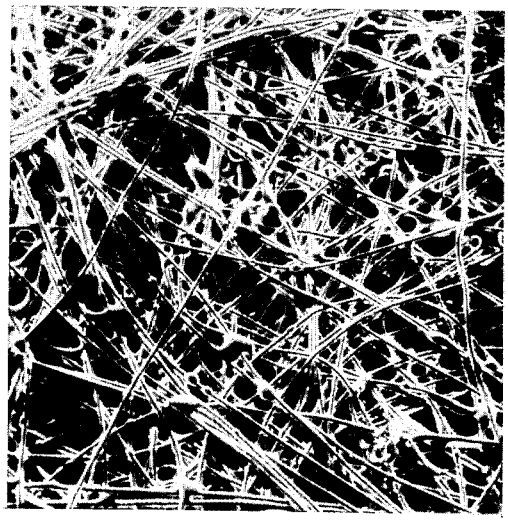
FIG. 1 is a detailed photographic depiction of the hard or highly consolidated surface of a non-woven fabric according to the invention.

The multiple-layered non-woven web according to the invention are employed as backing materials for the production of tufted carpets. Backing materials of this type must pass through numerous processing stages during the manufacture of tufted carpets, and the individual processing stages place very diverse demands on the carrier material. In connection with the processing stages involved in the manufacture of tufted carpeting, there is involved in particular the tufting procedure, during which the pile yarn is introduced into the carrier material by means of a needling procedure, a coloring or printing process, binding of the pile fibers by means of a coating process as well as an additional backing finish step involving application of, for example, double backing, embossed or compact foam.

The first process step during carpet manufacture, the tufting process, represents by itself a considerable demand upon each surface structure which is intended to be used as a backing, since in most cases a considerable stress on the backing is generated by the piercing action of a plurality of tufting needles. In the course of this processing step, a decrease in strength is to be observed with conventional materials. However, since the decrease of mechanical strength is disadvantageous in the case of a material which is very highly stressed as a floor convering, it was one object of the present invention to find a tuft backing which endures the tufting process without considerable decrease in the property of resistance to tearing.

A second problem associated with the tufting process resides in the satisfactory anchoring of the pile yarn in the backing material, particularly so that no loss of these pile yarn loops occurs during the subsequent processing steps, such as the dyeing or printing. The processing stages of dyeing and coating require a backing material which withstands the purely mechanical tensil stresses without large dimensional changes. This is especially important in case of manufacture of geometrically patterned carpets, which in the case of irregular straining result in a distortion of the pattern. Furthermore, a backing material for tufted carpets should be as dimensionally stable as possible even under the effect of elevated temperatures, in order to withstand the subsequent drying and coating procedures without damage.

To combine these multiple requirements of the production process was difficult in that they are to a certain extent countereffective against one another, because it has been shown that a certain elasticity of the backing is required for good bonding of the pile yarn, so that the backing surrounds the pile yarn after completion of the tufting procedure. On the other hand, the mechanical properties which lead to dimensional stability rather exclude elasticity of this type.

It has been demonstrated in accordance with the present invention that it is substantially more efficacious to employ as a tuft backing an isotropic non-woven web manufactured from continuous polyester filaments. The non-woven web should exhibit no preferred filament orientation in the individual layers, with which, however, a differentiation of the adhesive strengths throughout the thickness is effected. It has been surprisingly shown that as a result of this striven for variation of the adhesive strengths in the individual layers of the non-woven web, this backing material can fulfill the various requirements during carpet production and also in the finished carpet. It is, however, important in this regard that the filament direction and disposition of the individual layers is isotropic throughout. It is only the bonding of the fibers which is graduated throughout the thickness.

It has been demonstrated in accordance with the invention that this thusly-produced, multiple-layered non-woven web of continuous polyester filaments, which is bonded with binder fibers and which has graduated bonding throughout the thickness of the material is especially suitable as a tuft backing, if the surface employed during the tufting process as the stitching side exhibits a lower degree of bonding than the opposite side which faces the pile yarn. It has been shown that as a result the nap binding of the pile yarn into the backing fleece is substantially improved, since the looser side of the fleece more effectively holds the pile yarn loops by a wrapping-around action, and the subsequent bonding of the pile yarn, for example, with dispersions, is facilitated. The high degree of consolidation on the opposite side, i.e., on the side facing the pile yarn, improves the mechanical properties, for example, during the manufacturing process, especially the initial modulus of the tufted carpet intermediate product, so that during dyeing or during the process of coating the backing, only very small distortions arise. The isotropy as a result of symmetry of the filament directions, which manifest itself through comparable strengths in the longitudinal and transverse direction, protects the carpet from dimensional changes, which, especially, in the case of manufacture of geometrical patterns, would operate very disadvantageously. In the finished carpet, the highly consolidated upper side provides that no filaments of the tuft backing are removed and become mixed with the pile yarn. It has been shown that this construction of material is possible, especially in connection with the production of a fleece from continuous filaments, since in this context the differentiation of the various strength layers is possible to produce surfaces ranging from very strong to very weak bonding. This is because, as a result of the construction from continuous filaments, these are still held together to a satisfactory degree, whereas in the case of construction from short fibers, a removal and loss of individual fibers results.

In the case of construction of the fleece without a differentiation of this type in the bonding throughout the thickness of the material, there results, in the case of strong bonding, perforations by the tufting process which are too large, and in the case of bonding which is too weak, there results distortions during the processing steps which are too great. In the case of anisotropic construction of the fleece, such has already been suggested, as described above, in connection with which particularly high strengths are produced by means of corresponding fiber orientation in the processing direction, these different layers become so strongly anchored during the tufting procedure as a result of needle punching, that a decrease in strength in the transverse direction results from the tufting process. However, this is highly undesired, since as a result thereof, dimensional changes are produced again during further processing.

It has now been discovered in accordance with the present invention that a high degree of isotropy of the bonding strength toward the different sides (e.g. in the longitudinal and transverse direction) is necessary, whereas such isotropy is not desired throughout the thickness of the material. It has been surprisingly demonstrated also that this differentiating construction is of considerable advantage not only for the manufacture of the carpet, but also in that the properties of the finished carpet are also very considerably improved as a result thereof. In particular, the laying characteristics of the carpet are very positively influenced, since as a result of avoiding distortion processes during the processing stage, a desired, flat laying-out of the carpet is achieved when the carpet is ultimately utilized.

Figure 2:
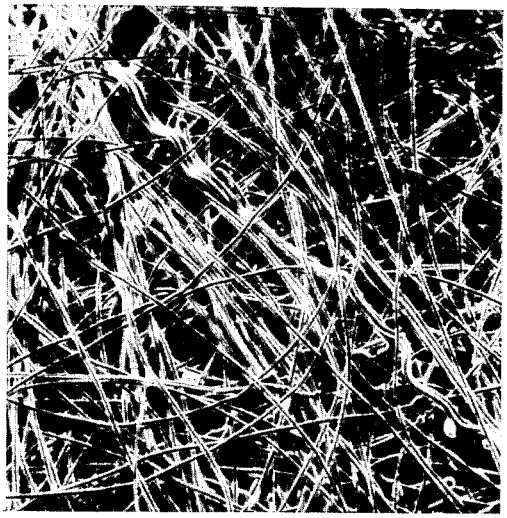
FIG. 2 is a detailed photographic depiction of the soft or weakly consolidated surface of such a non-woven fabric.

FIGS. 1 and 2 show the different surfaces of the fleece according to the invention, whereby the differential degree of bonding is very easily visible. The highly consolidated side of the fleece (FIG. 1), also referred to as the pile side, exhibits a considerably higher number of bonded locations of the filaments than the loosely consolidated side, which is the side of the fleece penetrated by the needles (FIG. 2).

Figure 3:
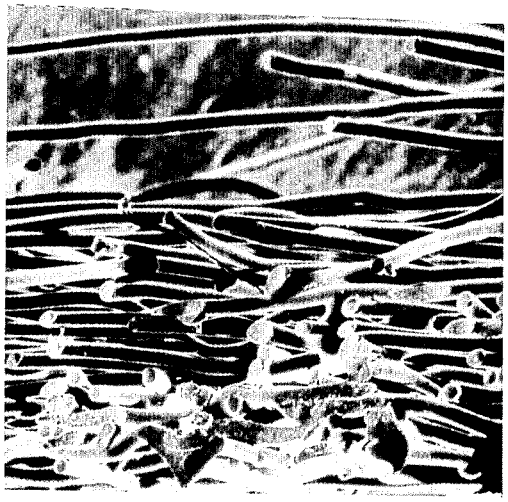
FIG. 3 illustrates a cross-section of a non-woven web or fleece according to the invention.

FIG. 3 illustrates a cross section of the fleece according to the present invention. From this figure, the differences in the morphology and number of bonds are very readily observed.

Figure 4:
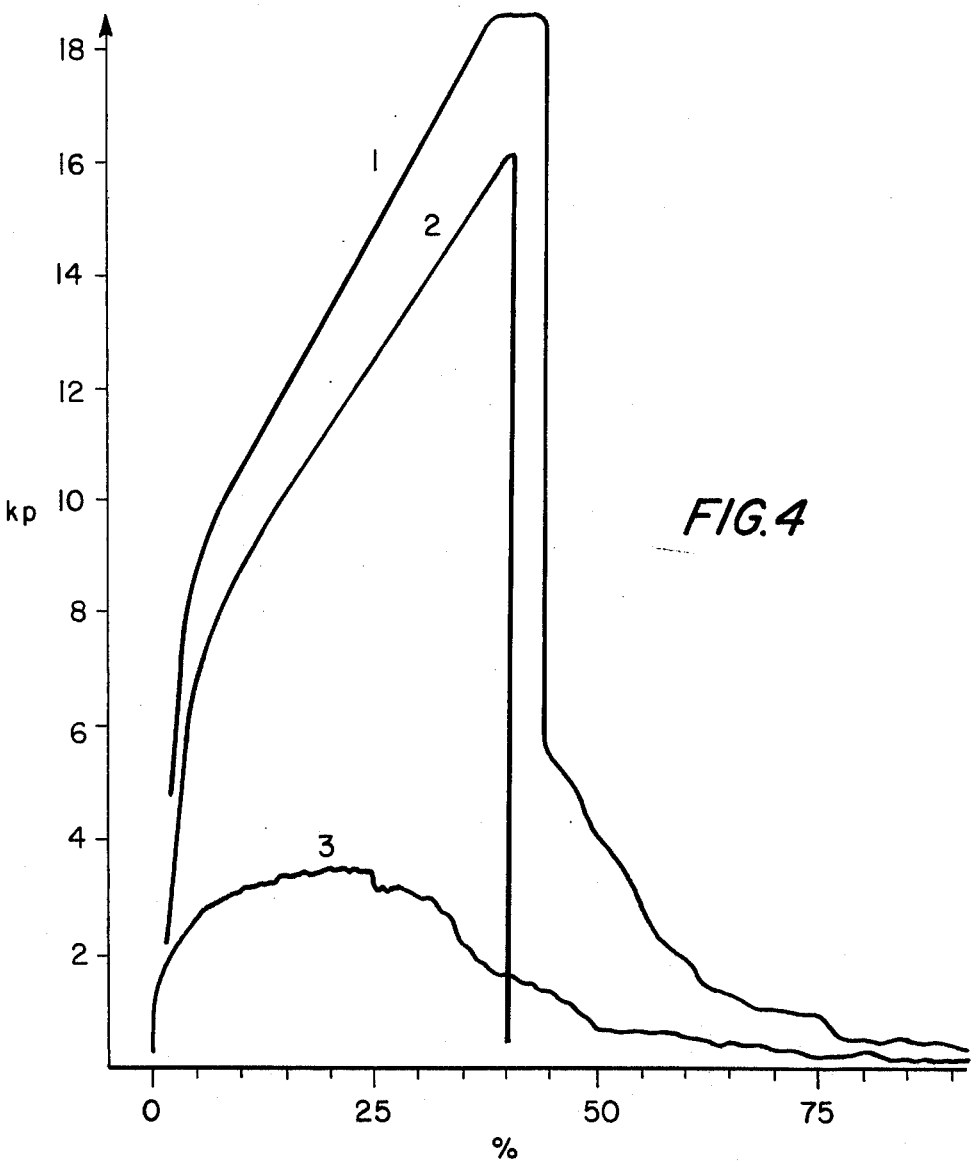
FIG. 4 represents three stress-strain diagrams of a non-woven fabric of the invention.

FIG. 4 illustrates three stress-strain diagrams of a fleece according to the invention. Diagram 1 represents the stress-strain relationship in the case of tearing of the entire fleece. Diagram 2 describes the tearing behavior of the densely consolidated layer of a fleece which has been divided into two layers of equal thickness, and diagram 3 represents the tearing behavior of the loosely consolidated layer. It is observable from the configuration of the diagrams 2 and 3 how the two layers complement one another in the fleece.

A multiple-layered non-woven bonded together by binder fibers can be produced, for example, in accordance with German Offenlegungsschriften Nos. 1,560,801 or 2,240,437. Non-woven fleeces of this type bonded together with the aid of binder fibers are produced by simultaneous spinning of system fibers and binding fibers. The differentiation in binding of the different layers can be carried out on one side in the manner so that, for example, according to German Offenlegungsschrift No. 1,560,801, a high concentration of binder fibers results in the one surface. A higher concentration of binding filament can also result by adjustment to a finer denier; this leads to an increase of the contact points in connection with bonding. A higher degree of bonding, however, can also be accomplished by means of a step-wise consolidation of the non-woven web, i.e., the differentiation of the fleece construction can be obtained either by variation of the filament mixtures or by variation of the consolidating bonds. The variation of the consolidating bond or intensity of consolidation can be accomplished in such a manner that one of the surfaces of the fleece is subjected to higher temperatures than the other. The side which is to be bonded more weakly can also be treated before the heat treatment with aqueous media, in order that a graduated effect is produced during consolidation.

The present invention will be illustrated more clearly with reference to the following specific examples, it being understood that the same are intended to be merely illustrative and not in any sense limitative.

EXAMPLE 1

For the production of a non-woven web in accordance with the invention, there is employed a spinning installation which is comprised of a plurality of spinning positions. Each spinning position has two spinning nozzles (A and B) of elongated configuration having spinning orifices arranged in the form of rows, which are arranged parallel to one another. The individual spinning positions of the spinning installation have a spacing with respect to one another of 400 mm., whereby the elongated spinning nozzles of the entire installation are arranged parallel and in diagonal order above a collecting belt, similarly to the oblique-angle arrangement illustrated in German Offenlegungsschrift No. 1,560,790.

The spinning nozzle A serves for spinning of system filaments and includes 64 apertures, the capillary diameter of which is 0.3 mm. and the capillary length of which is 0.75 mm. The apertures are arranged in two mutually displaced rows over a length of 280 mm.

The spinning nozzle B serves for spinning of the binder filaments and has 32 apertures uniformly distributed in a row over the length of 280 mm. The apertures have the same capillary diameter and the same capillary length as those of the spinning nozzle A.

All of the spinning nozzles A of the spinning installation are combined in the spinning system A and are provided with polyester melt from a spinning extruder, whereby each spinning nozzle is provided with a spinning pump.

Likewise, all spinning nozzles B are combined in a spinning system B and are supplied with a co-polyester melt via a spinning extruder.

The filaments which are produced by the two spinning nozzles of each spinning position are blown with air below the spinning nozzles along a distance of 150 mm. transverse to the running direction of the filaments, and subsequently, the filaments are assembled in the form of an elongated filament bundle or band, in which both filament components are uniformly blended. The filament band is led through a cooling chamber and is directed to an aerodynamic take-off device.

The aerodynamic take-off device represents a discharge channel of elongated form, the length of which amounts to 300 mm. and the breadth of which is 6 mm. This discharge channel is provided on both longitudinal sides with an air pressure take-off slot, which expands in width along the entire length of 300 mm. and which is connected with an air pressure chamber. The air speed in the channel profile is varied by adjustment of the air pressure, and the conditions for withdrawing the filaments are thereby controlled.

The filament bands which exit from the lower opening of the air channel, which bands are comprised of very well blended polyester and co-polyester filaments which run parallel to one another, are then brought into a periodic pendulum movement by means of a swinging device, and then they are led to an endless perforated metal band which moves transversely to the pendulum direction. As a result of the impingement of the filament bands onto the perforated band, an irregular fleece is formed. The driving air with which the filaments are drawn-off, is removed by suction under the perforated band.

A calendar is arranged directly downstream of the guide roller of the endless perforated band in the direction of the movement. The working portion of the calender is comprised of two rollers which are heated to differing degrees. The job of this calendar is to achieve a sufficient preconsolidation of the fleece, however, a consolidation which differs throughout the entire thickness of the fleece. For this purpose, the upper calender roller is heated to a lower temperature than the lower calender roller.

The pre-consolidated fleece is then sprayed on one side with an aqueous dispersion of dimethylpolysiloxane and hydroxy methyl-polysiloxane, whereby both components are polymerizable at higher temperatures, so that in essence, only the upper, already less-consolidated and more open side of the fleece is wetted with the dispersion. The thus-consolidated and sprayed fleece is then directed to the actual consolidating apparatus. This device consists of a perforated drum having an endless perforated band extending therearound. The fleece is then led into the gap between the perforated drum and the perforated band passing therearound, and thus during the consolidation step is held on the surface and is pressed against the drum, whereby the soft side of the fleece wetted with coating material faces the drum. Hot air is then permitted to stream through the fleece from the direction of the uncoated side.

The fleece consolidated in this manner exhibits a clearly different degree of consolidation throughout the thickness of the fleece. The harder, more strongly consolidated side, which travels over the calendar roller which is heated to a higher temperature, in which the spraying device for the coating composition is averted, and thus in essence is not wetted, and which subsequently is subjected to the air penetration in the consolidting apparatus, exhibits a very high abrasion resistance. On the other hand, the other side of the fleece, which is more lightly pre-consolidated and which is treated with the coating composition, is only very lightly consolidated, so that individual filaments may be pulled out up to a certain length by rubbing.

The spinning conditions are summarized in the following Table:

TABLE 1

| | Spinning System A Polyethylene Terephthalate | Spinning System B Polyethylene Terephthalate-Co-adipate |
|---|---|---|
| Rel. Viscosity in o-Chlorobenzene (2 parts by weight -Phenol (3 parts by weight) | 1.36 | 1.40 |
| Melt temperature (° C.) | 290 | 270 |
| Amount supplied per spinning nozzle (kg/min) | 0.385 | 0.100 |
| Filament velocity (m/min) | | |
| $v_0$ - at aperture exit | 70 | 37 |
| $v_2$ - in take-off channel | 5000 | 4800 |
| Air speec in take-off channel (m/min) | 13000 | 13000 |
| Filament values: | | |
| Denier (dtex) | 12 | 6.5 |
| Strength (p/dtex) | 3.4 | 3.1 |
| Elongation (%) | 90 | 110 |
| Heat shrinkage (%) | 4 | 15 |

The polyethylene terephthalate before spinning has a relative viscosity of 1.36, measured as a 0.5% solution in a mixture of ortho-dichlorobenzene (2 parts by weight) and phenol (3 parts by weight). In the case of the copolyester, the product employed is polyethylene terephthalate-co-adipate comprising 20% adipic acid having a relative viscosity of 1.39. The crystalline melting point is 200° C.

The weight per unit area of the irregular fleece is adjusted during manufacture to 135g/m$^2$. The upper roller of the pre-consolidation calendar is heated to a temperature of 95° C., and the lower roller to a temperature of 115° C. The linear pressure amounts to 50 kp/cm of width.

The amount of the coating composition is controlled via the spray device so that 0.10 gram of a hydroxy methyl polysiloxane and 0.15 gram of dimethyl polysiloxane are applied per square meter on the upper side of the fleece.

The temperature of the heated air in the consolidation apparatus is adjusted at 205° C., whereby the fleece is subjected to the air throughout for a period of 60 seconds. The amount of air is 1.9 m$^3$/m$^2$/sec. of perforated surface. The finished fleece exhibits the following physical properties:

TABLE 2

| | Longitudinal | Transverse |
|---|---|---|
| Breaking load (kp) | 22.0 | 21.5 |
| Breaking elongation (%) | 45 | 42 |
| Resistance to penetration (kp) | | |
| measured from the soft side | 0.560 | 0.560 |
| measured from the hard side | 0.680 | 0.680 |
| Bending resistance (kp/cm$^2$) | | |
| measured from the soft side | 15.8 | 8.63 |
| measured from the hard side | 3.6 | 4.24 |
| Linear shrinkage in hot air at 160° C. (%) | 1 | 2 |

The breaking load of the untufted fleece is measured according to DIN 53-857. With the tufted material, the procedure is carried out in a similar fashion, whereby the test samples are taken once along the tuft rows, and another time transverse to the tuft row.

In order to examine the cutting resistance, a special testing method is developed in connection with which tuft backings in the form of a 5 cm wide strip are pierced with a row of Singer needles (type GY-0637) without yarn. The cutting resistance which the material performs is determined by means of an electronic measuring head, is stored in a computer and is evaluated as the mean value of approximately 600 piercings.

Likewise for the calculation of the bending resistance, a special testing method is applied in connection with which there is measured the force which is required to bend a test strip. In this regard, the material is clamped both in the machine direction of the production installation (longitudinal direction) and also in the direction lateral to the production direction. In order to examine the differences in the consolidation of the material over the thickness thereof, the testing is carried out once from the soft side of the fleece (the side which is penetrated by the tufting needles) and another time from the hard side of the fleece.

The linear shrinkage is measured on a DIN A 4-Test Sample, which is exposed for 10 minutes to the effect of hot air in a freely-resting horizontal position in a drying cabinet adjusted to the testing temperature.

In addition, the finished, consolidated fleece is subjected to an extraction analysis in water, in connection with which it is determined that only an indeterminably measurable fraction of the applied silicone components goes into the extraction medium. As a result, the important prerequisite is met that the material can exert no detrimental influence upon foam formation in the coloring bath during the continuous dyeing process.

The specific strength parameter A of the entire fleece is calculated by dividing the breaking load by the weight per unit surface area (135 g/m²), and amounts in the longitudinal direction to 163 and in the transverse direction to 159.

In order to further determine the difference in strength over the thickness of the fleece, numerous 5 cm wide test samples are split into two layers having the same thickness. The breaking load for the separated test samples is determined in accordance with DIN 53-857. The values determined in accordance therewith are summarized in Table 3, whereby the values given are represented as the average of 10 measurements.

TABLE 3

| | Light Consolidated Layer | Highly Consolidated Layer |
|---|---|---|
| Breaking load (kp) | 2.2 | 20.9 |
| Thickness (mm) | 0.446 | 0.36 |
| Density (g/cm³) | 0.1316 | 0.1808 |

The fleece produced in accordance with Example 1 is employed as a tuft backing, whereby the process is carried out on a tufting support having a needle separation of 0.397 cm and a stitch thickness of 0.32 cm. There is employed as the pile yarn a crimped polyamide continuous yarn with an overall denier of 2900 dtex (DuPont Nylon 876). The tufting machine is equipped with Singer needles (Type GY 0637). During the tufting procedure, the material is turned with its soft side (stitch penetrating side) toward the tufting needles. The thus-tufted intermediate material exhibits the physical properties summarized in Table 4.

TABLE 4

| | Longitudinal | Transverse |
|---|---|---|
| Breaking load (kp) | 24.5 | 22.0 |
| Breaking elongation (%) | 51 | 53 |
| Resistance to further tearing (Kp) | 18 | |
| Strength Parameter B | 181 | |
| Strength Parameter C | | 148 |

For determination of the resistance to further tearing, a special testing method is developed, in connection with which a sample 20 × 15 cm is cut in the middle along the longer edge for a length of 10 cm. This test sample is then clamped into a dynamometer, so that the cut edge is arranged perpendicularly to the direction of loading. During loading of the test sample, the maximum required force is read off. The test sample is cut along the rows of tufts.

The carpet exhibits very good dimensional stability during the pad dyeing process as well as in the case of dyeing on a continuous installation. Thus, the loss in width during the processing amounts to nearly 3% of the beginning width. In addition, the carpeting distinguishes itself with very good dimensional ability over the entire surface thereof. Thus, in the case of a strict geometric pattern, which is printed on the carpet, the greatest deviation from a straight line amounts to less than 1 cm. over a width of 404 cm.

The thermal stabiity of the material is so good that the drying temperature after dyeing or printing can be raised up to 170° C., and this temperature is limited merely by the thermal stability of the yarn material in the carpet and of the dye-stuffs employed.

Coating of the carpet is accomplished in two stages, as is conventional. In the first stage, the yarn loops are bonded with a latex dispersion which is applied by means of two padding devices connected in series. This preliminary coating is prevulcanized in a dryer. The amount applied is approximately 800 g/m², calculated based upon the dried substance.

In the second stage, the back side of the carpet is provided with a 4 mm. thick layer of latex foam, and the layer is vulcanized. The course of the coating operation likewise provides evidence for the excellent surface stability of the carpeting material, although this procedure is carried out in the dryer at a temperature of 160° C.

After the finished carpet is spread out over a length of 20 meters on top of a smooth underlayer, it is characterized by a very flat and distortion-free laying behavior. In the case of the finished product, strength values are achieved which are summarized in Table 5.

TABLE 5

| | Longitudinal | Transverse |
|---|---|---|
| Breaking load (kp) | 39 | 35 |
| Breaking elongation (%) | 53 | 38 |
| Resistance to further tearing (Kp) | 16 | |

Comparative experiments are carried out, by means of which it is illustrated that materials which do not possess the parameters of the material according to the present invention do not fulfill the requirements which arise in actual practice.

COMPARATIVE EXAMPLE 1

The same apparatus is employed as that described in Example 1 and the same conditions of operation are followed. The sole difference is that the air temperature in the consolidation apparatus is adjusted to 200° C. The thus-produced fleece has the following characteristics summarized in Table 6.

TABLE 6

| | Longitudinal | Transverse |
|---|---|---|
| Breaking load (kp) | 15.5 | 15.0 |
| Breaking elongation (%) | 46 | 46 |
| Resistance to penetration (kp) | | |
| Measured from the soft side | 0.420 | 0.420 |
| Measured from the hard side | 0.480 | 0.480 |
| Strength | 110 | 115 |

After the fleece backing is tufted in the same manner, it is shown that the material does not have sufficient stability during the pad dyeing process, since the loss in width is approxmately 10% of the beginning width.

The strength values of the tufted material are represented in Table 7.

TABLE 7

| | Longitudinal | Transverse |
|---|---|---|
| Breaking load (kp) | 26.5 | 24 |
| Breaking elongation (%) | 63 | 65 |
| Strength parameter B | 196 | |
| Strength parameter C | | 178 |

Although the fleece prepared in accordance with the conditions of this example exhibits a clearly layered construction, the strength parameter A is not sufficient in order to lend to the tufted intermediate material a sufficient dimensional stability in the wet surface treatment.

COMPARATIVE EXAMPLE 2

The same device as described in Example 1 and the same conditions as described there are again employed.

The only difference is that the silica-containing coating material is applied to the finished product after it exits from the consolidating apparatus, whereby the composition and also the amount remain the same.

The strength values of this fleece backing are summarized in Table 8.

TABLE 8

| | Longitudinal | Transverse |
|---|---|---|
| Breaking Load (kp) | 25 | 25 |
| Breaking elongation (%) | 30 | 32 |
| Resistance to puncture (kp) | | |
| Measured from the soft side | 1.266 | 1.266 |
| Measured from the hard side | 1.398 | 1.398 |
| Bending resistance | | |
| Measured from the soft side | 17.4 | 6.7 |
| Measured from the hard side | 16.9 | 6.9 |
| Strength parameter A | 185 | 185 |

In Table 8, the soft side is characterized — similarly as in Example 1, as the side which faces the calender roll having the lower temperature.

After tufting with the standard adjustment — as described in Example 1 — it is determined that the loop content of the material is so poor that there results a pulling-out of the individual yarn loops during further processing. The tufted product exhibits strengths which are set forth in Table 9.

TABLE 9

| | Longitudinal | Transverse |
|---|---|---|
| Breaking load (kp) | 17 | 14 |
| Breaking elongation (%) | 43 | 43 |
| Resistance to further tearing | 12 | |
| Strength parameter B | 126 | |
| Strength parameter C | | 105 |

The carpet produced from this half-material have a very low resistance to tearing, which hinders a stretching thereof.

The fleece prepared according to the process conditions of this Example exhibits only small differences in the degree of consolidation of the individual fleece layers over the thickness of the fleece.

After the partial coating, strength values are achieved on the remainder of the fleece which, after calculation as strength parameter A lie below the values of the original fleece. In addition, the small differences in connection with the bending resistance demonstrate in essence uniform consolidation over the entire thickness of the fleece.

What is claimed is:

1. A multiple-layered non-woven fabric suitable as a backing for tufted carpet, comprising randomly oriented synthetic filaments having points of bonding therebetween, said fabric exhibiting substantially isotropic strength parameters over its surface, said fabric having a weight per unit area of between about 100 and 150 metric pounds/m$^2$, said fabric having in an untufted condition a specific strength parameter A equaling at least 130, wherein $$A = \frac{\text{Breaking load of a 5 cm. wide strip in p}}{\text{Weight per unit area in p/m}^2}$$

and said fabric having, after tufting with a continuous synthetic filament, a strength parameter B$\geqq$ 0.9 A, but at least 140, wherein $$B = \frac{\text{Breaking load of a 5 cm wide strip in p, measured along the tuft rows}}{\text{Weight per unit area of the fabric in p/m}^2}$$

and a strength parameter C$\geqq$ 0.8 A, but at least 120, wherein $$C = \frac{\text{Breaking load of a 5 cm wide strip in p, measured transverse to the tuft rows}}{\text{Weight per unit area of the fabric in p/m}^2}$$

said points of bonding between said randomly oriented continuous synthetic filaments being clearly graduated with respect to their number, magnitude and configuration over the thickness of said fabric, with both sides of said fabric differing from each other as regards said filament bonding.

2. The non-woven fabric as defined by claim 1, wherein said fabric comprises two layers of equal thickness, including a first densely consolidated layer and a second loosely consolidated layer, wherein (a) the tensile strength of said first layer is at least twice the tensile strength of said second layer, and (b) the density of said first layer is at least 1.2 times the density of said second layer.

3. The non-woven fabric as defined by claim 2, wherein said fabric exhibits a bending resistance measured in the direction from said second layer which is at least 1.5 times the bending resistance measured in the direction from the first layer, and the bending resistance of said first layer, and the bending resistance of said first layer is at least twice the bending resistance of said second layer in a fabric consisting of only two layers of equal thickness.

4. The non-woven fabric as defined by claim 3, wherein the bending resistance measured in the direction of said second layer is at least twice the bending resistance measured from the direction of said first layer.

5. The non-woven fabric as defined by claim 1, wherein said randomly oriented continuous filaments are comprised of a fiber-forming polyester resin, and said continuous tufting filament is comprised of a fiber-forming polyamide resin.

6. The non-woven fabric as defined by claim 5, wherein said randomly oriented continuous filaments comprise a first type of system filaments of a polyester resin and a second type of binding filaments of a copolyester resin having a melting point below that of said polyester resin in said first type of filaments.

7. The non-woven fabric as defined by claim 6, wherein the ratio of said first type of synthetic filaments to said second type of synthetic filaments is between about 3:2 and 5:2.

8. The non-woven fabric as defined by claim 1, produced according to a process comprising the steps of:

a. spinning a plurality of first system filaments from a spinnable, fiber-forming polyester resin;

b. spinning a plurality of second binding filaments from a spinnable, polymeric material having a melting point from about 160° C. to 230° C. parallel to said first filaments, whereby there is formed a plurality of parallel filament bundles comprising a mixture of said first and second filaments;

c. cooling said filament bundles;

d. aerodynamically conveying said filament bundles and depositing them in the form of a random web;

e. passing said web through a calendaring device having a first roller at a temperature of from about 20° to 120° C. and second roller at a temperature of from about 90° to 130° C., said second roller being at a temperature at least 10° C. higher than said upper roller, whereby a pre-consolidated web is formed;

f. coating the side of said pre-consolidated web subjected to said first roller with an aqueous dispersion comprising a dimethylpolysiloxane; and g. passing a gas heated to a temperature of from about 160° to 230° C. through said coated, pre-consolidated web from the uncoated side of the web.

9. The non-woven fabric as defined by claim 8, wherein said polyester resin is polyethylene terephthalate and is supplied at a rate of from about 4 to 7 g/min from each spinning aperture, wherein said polymeric material is a copolyester and the ratio of polyethylene terephthalate filaments to copolyester filaments in said bundles is between about 3:2 and 5:2.

10. The non-woven fabric as defined by claim 8, wherein step (d) comprises aerodynamically conveying said filament bundles at a velocity of between about 2000 and 10,000 m/min, reciprocally depositing said bundles on a perforated surface and drawing-off the aerodynamic medium through said perforated surface.

11. The non-woven fabric as defined by claim 8, wherein said heated gas in step (g) is air or steam.

12. A tufted carpet comprising as a backing member the non-woven fabric as defined by claim 1 and a plurality of tufts secured in said backing member.

13. The tufted carpet as defined by claim 12, wherein said tufts comprise loops of continuous polyamide filaments.

* * * * *

UNITED STATES PATENT AND TRADEMARK OFFICE

CERTIFICATE OF CORRECTION

PATENT NO. : 4,093,763

DATED : June 6, 1978

INVENTOR(S) : Hartmann et al

It is certified that error appears in the above-identified patent and that said Letters Patent are hereby corrected as shown below:

In the ABSTRACT, line 6, "graduaton" should be -- graduation --.

In the SPECIFICATION:

Col. 8, line 16, "air throughout" should read -- air throughput --.
" . 9, " 13, "average of" should read -- average value of --.
" . ", Table 3, line 15, "Light Consoli-" should read -- Lightly Consoli--
" . ", line 43, "sample 20" should read -- sample measuring 20 --.

In the CLAIMS:

Col. 13, Claim 8, line 3, "20° to 120°C." should read -- 80° to 120°C. --.
" . ", " ", " 6, "upper roller" should read -- first roller --.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*

UNITED STATES PATENT AND TRADEMARK OFFICE

CERTIFICATE OF CORRECTION

PATENT NO. : 4,093,763

DATED : June 6, 1978

INVENTOR(S) : Hartmann et al

It is certified that error appears in the above-identified patent and that said Letters Patent are hereby corrected as shown below:

In the SUMMARY OF THE INVENTION:

Col. 1, line 59, "pounds" should be -- ponds --.

In the CLAIMS:

Col. 11, line 58, "pounds/$m^2$" should be -- ponds/$m^2$ --.

Signed and Sealed this

Ninth Day of December 1980

[SEAL]

Attest:

SIDNEY A. DIAMOND

Attesting Officer

Commissioner of Patents and Trademarks